US007351924B2

(12) United States Patent
Scherl et al.

(10) Patent No.: US 7,351,924 B2
(45) Date of Patent: Apr. 1, 2008

(54) KEY SWITCH WITH A DEVICE FOR KEY MONITORING

(75) Inventors: Josef Scherl, Neunburg (DE); Ralf Tomaschek, Fürth (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/403,843

(22) Filed: Apr. 14, 2006

(65) Prior Publication Data

US 2007/0199807 A1 Aug. 30, 2007

(30) Foreign Application Priority Data

Feb. 24, 2006 (DE) ..... 20 2006 003 139 U

(51) Int. Cl.
*H01H 27/06* (2006.01)

(52) U.S. Cl. ..... 200/43.08; 200/43.04; 200/61.66

(58) Field of Classification Search .. 200/61.66–61.68, 200/43.04, 43.08, 273, 252, 260, 274; 70/387, 70/388

See application file for complete search history.

(56) References Cited

U.S. PATENT DOCUMENTS 3,026,385 A * 3/1962 Davis et al. ..... 200/43.13
3,320,782 A * 5/1967 Turman ..... 70/388
3,665,128 A * 5/1972 Schaad et al. ..... 200/43.04
3,793,497 A * 2/1974 Di Gaetano ..... 200/43.08
3,826,116 A * 7/1974 Messera et al. ..... 70/388
3,971,242 A * 7/1976 Mikos ..... 70/388
4,264,792 A * 4/1981 Gillette ..... 200/43.08
4,634,822 A * 1/1987 Goeke ..... 200/43.08
6,969,810 B1 11/2005 Davidsz

FOREIGN PATENT DOCUMENTS

DE 88 00 701 U1 4/1988
EP 0 412 374 B1 6/1993

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

A key switch is disclosed, including a key channel for receiving a key and including a key-insertion-dependent switching mechanism. The switching mechanism exhibits a device for key monitoring. A key switch is specified which can be inexpensively manufactured and exhibits additional security-related options. For this purpose, the key switch exhibits a device for key monitoring which exhibits a quasi-rigid system arranged axially in the key channel, which are provided for key ejection and for operating a switching element.

18 Claims, 3 Drawing Sheets

KEY SWITCH WITH A DEVICE FOR KEY MONITORING

The present application hereby claims priority under 35 U.S.C. §119 on German patent application number DE 20 2006 003 139.1 filed Feb. 24, 2006, the entire contents of which is hereby incorporated herein by reference.

FIELD

The invention generally relates to a key switch with a device for key monitoring; for example one which has a key-insertion-dependent switching mechanism and a key channel for receiving a key.

BACKGROUND

Such a key switch is used, for example, in automated production plants or devices with possibilities for intervention for manual operation or control of processes which are activated via electrical switching elements.

Further applications are conceivable in technical facilities in which unwanted or unauthorized activation of an operating state of the facility, which includes certain hazards, must be prevented.

In the so-called set up mode of an automated production plant or device, for example, so-called key switches are preferably used today which can only be operated by the key in position of the authorized person. Using key switches with key monitoring makes it possible both to prevent the key from being forgotten in the key switch and unauthorized switching in an unsecured operation of the production plant or device since, similarly to the removal, the insertion of the key can also be detected.

The current state of the art teaches key monitoring which is implemented, for example, by use of a micro-switch which is mounted in the key channel. In known key switches with key monitoring, an ejection or dropping out of the key is provided when the micro-switch is not yet operated. It is a disadvantage that the micro-switches used in most cases do not have mandatory contact opening and are mechanically sensitive to soiling and foreign bodies. Furthermore, the assembly of the micro-switch solution is very expensive and has a relatively short service life.

From EP 0 412 374 B1, a key switch is known which only enables an altered operating state of a technical facility to be activated when the key is removed. By way of the key inserted by a minimum depth, a switching contact is operated in a micro-switch located in the key channel of the key switch. In this arrangement, the key is held in the key channel without external support once the minimum depth has been reached.

For reasons of security and authorization it is desirable to eject the key out of the key channel when the key switch is not operated. For this purpose, the current state of the art provides mechanisms which are based on a restoration effect on the key. The restoration effect can act permanently on the key and be blocked in the operated position. This ensures that, when the key switch is operated, the key remains in the key channel whereas the key can be automatically ejected in the non-operated position.

From DE 88 00 701.4 U1, a control switch is known which ensures, by way of a return spring, that after the key has been turned into an off position and released, it is pressed out of the switch.

Furthermore, a type of key monitoring must be called disadvantageous which only triggers an operation of a switching element for detection of the key close to the end position of the key. This is because, in this arrangement, the key is in the vicinity of the initial position in the key channel without being detected.

From U.S. Pat. No. 6,969,810 B1, a key switch is known which performs a detection of the key close to the end position and prevents the key from remaining in the key channel by way of a spring mechanism.

SUMMARY

At least one embodiment of the invention includes an object of improving a key switch, in such a manner that it exhibits no restrictions with regard to installed position and service life, can be produced inexpensively and exhibits additional security-related options.

An object may be achieved by a key switch in that the device for key monitoring in the key channel exhibits at least one axially moveable quasi-rigid system including a transmission device for operating at least one actuator of the key switch, wherein in a first state of the quasi-rigid system, a relative position of the transmission devices with respect to one another cannot be changed, and in a second state of the quasi-rigid system, the relative position of at least one transmission device with respect to another transmission device can be changed, the quasi-rigid system being in the first state or second state in dependence on the key position in the key channel.

At least one embodiment of the invention is based on the finding that in the key switch known from EP 0 412 374 B1, no mandatory opening is available and it also exhibits distinct restrictions with regard to the switching voltage and the switching current. A further disadvantageous limitation is the permissible switch panel thickness. The solution described in the said document allows a maximum switch panel thickness of 4 mm which is restrictive compared with a general standard value of 6 mm. Furthermore, the above-mentioned disadvantages of a micro-switch solution or of a detection of the key at a later time in the insertion process are of importance.

According to at least one embodiment of the invention, the key switch exhibits a key-insertion-dependent switching mechanism, the switching mechanism exhibiting a device for key monitoring. The device for key monitoring is at least partially arranged at a key channel. Transmission devices of the device form a quasi-rigid system which can be in a first or a second state. In the first state it is ensured that even with partial insertion of the key, the latter is detectable by way of the actuation of at least one actuator.

In this arrangement, the transmission devices of the quasi-rigid system in their totality operate similar to an integral force transmitter which transmits the dynamic effect of the key to the actuator. In the second state, the quasi-rigid system is provided for compensating for the difference between the key links and the actuating path of the actuator in that at least one transmission device of the quasi-rigid system moves in relation to another transmission device. Thus, the transfer of a multiple function of the device overall includes a reduction in components and, at the same time, an extremely economic implementation of the functions according to the invention.

Compared with a commercially available key switch, there are no handling disadvantages or deviations, for example in the external shape. As a consequence, the key switch according to at least one embodiment of the invention exhibits no restrictions whatever with regard to the functionality or the assembly. The reliability, ruggedness and service life of the key switch according to the invention corresponds to the known and proven construction of less functional key switches and, at the same time, the above-mentioned advantages according to at least one embodiment of the invention are guaranteed. Furthermore, the external shape which has remained the same, proves to be advantageous in the respect that the key switch according to at least one embodiment of the invention can be combined and/or inserted with previously known switching elements.

In an advantageous embodiment the effect of the restoring force on the key is different in the first and second state. In this manner, it is possible to provide a key ejection mechanism which releases the key in its removeable position (in contrast to a switching position) and the key can be ejected by the effect of the restoring force in the second state of the quasi-rigid system. If, in contrast, the key is in a switching position which is characterized by a particular angle of rotation of the key, the restoring force of the elastic element has no effect, for example because it is blocked.

Advantageously, the quasi-rigid system is used for, among other things, generating different effects of restoring force on the key in dependence on the key position in the key channel. Generating different effects of restoring force can be done, for example, by using elastic or resilient elements which are connected in series with respect to force. For example, using different elastic elements makes it possible to move transmission means which contain at least one of the elastic elements which, although it is pretensioned during the movement, can be loaded elastically in dependence on the key position.

Thus, there are key positions in which at least one of the elastic elements only acts as force transmitter. In distinction from this, there are other key positions in which at least one of the elastic elements is elastically loaded. This constitutes an important feature of the quasi-rigid system, namely that at least one elastic element, as transmission device(s), belongs to the system at least partially in the function as force transmitter.

The quasi-rigid system is also advantageous because the transmission device(s) involved can be used for detecting the key in the key channel, on the one hand, and due to the spring effect of the elastic element which is translated by means of the quasi-rigid system, it is also possible to manage the ejection of the key.

In an advantageous embodiment, the quasi-rigid system can be in at least two possible phases. The key positions in which the quasi-rigid system is in the first state belong to the first phase of the insertion process. In consequence, the first state corresponds to a detection state, that is to say when the moveable elastic element, as a pure force transmitter, is not deformed but only axially translated. In the second phase, key positions are possible, a different restoring force effect being generated by elastic loading of the elastic element moveable by way of the quasi-rigid system. This loading leads to a restoring defect on the key in the key channel.

The transmission device(s) advantageously have at least one first elastic element and one second elastic element. The first elastic element mainly causes the restoring force which is necessary for transporting the key out of the key channel. The second elastic element, in contrast, is provided for buffering the transmission means or the quasi-rigid system, respectively, in the key channel. The actuator of the switching element is actuated during the loading of the second elastic element. In consequence, it is advantageous to design the spring force of the second elastic element to be less in comparison with the spring force of the first elastic element. On the one hand, the insertion of the key during the first phase is facilitated and, on the other hand, unwanted actuations of the actuator without key insertion are prevented.

The second elastic element is advantageously operated by a force transmission via the first element. The force effect of the key is transferred to the second elastic element in such a manner that this force transmission takes place via the first element arranged inside the second element. As a result, the geometry of the transmission device(s) is optimized since only one axis is relevant with regard to the force transmission, namely the axis of the key channel. This leads to a simplification of the key switch and contributes to its ruggedness. The geometry achieved by this means also provides for a positive-locking force effect on the actuator in the case where the elastic elements are not operable, for example for reasons of wear or of a malfunction. This ensures that the actuator of the switching element can be operated even if the ejection function, which is also guaranteed by the transmission device(s), fails.

It is advantageously possible that at least the first element can be pretensioned in such a manner that, during reception of the key, essentially first the second element and then the first element can be deformed. In this manner, the spring force effects of the two elements can be transposed onto the respective phase in which the quasi-rigid system is located. The restoring forces of the respective phase can thus be determined by a selective choice of the first or second element, respectively.

The transmission device(s) advantageously have a telescopic rod for the axial transmission of force from the key to the first elastic element. For optimum force transmission, it is advantageous that the force effect is optimally transmitted from the key to the transmission device(s).

For example, the telescopic rod can be arranged axially in the key channel so that the force transmission is optimal. In this connection, it is also advantageous if the telescopic rod contains the first elastic element and/or is provided for guiding it. The telescopic rod thus prevents the elastic element from being impaired by external influences such as, for example, dirt which is introduced into the key channel by the key.

On the other hand, it is possible to provide the telescopic rod as guide for the first elastic element in that the telescopic rod is at least partially constructed to be hollow. This results in advantageous space saving which has a positive effect on the overall volume of the key switch. For optimal adaptation to the length of the key channel or to the first elastic element, it is conceivable that the telescopic rod is constructed to be at least partially solid and partially hallow.

The transmission devices advantageously exhibit a telescopic sleeve which at least partially contains the telescopic rod and/or is provided for guiding it. The telescopic rod exerts a force effect on the telescopic sleeve via the first elastic element. The telescopic sleeve is provided for acting on the actuator of the switching element. For this purpose, the telescopic sleeve is supported in the key channel by use of the second elastic element and, on the other hand, can be moved by the effect of the force of the key via the telescopic rod and the first elastic element. Due to the fact that the telescopic sleeve at least partially guides the telescopic rod, a stable mechanism can be ensured. Furthermore, a very long key channel can be achieved due to the fact that the telescopic sleeve can at least partially accommodate and guide the telescopic rod.

Furthermore, key-position-dependent decouplings of the effect of the key force on the second elastic element can be advantageously provided within the key channel. The decoupling leads to the second elastic element being elastically loaded only up to a limit but the first elastic element remains loadable. This blocking determines, for example, the transition from the first to the second phase or the transition of the quasi-rigid system from the first to the second stage, respectively, and represents a low-effort way of designing a phase transition.

It is advantageous to provide an insulating sleeve between the telescopic sleeve and the actuator for actuating the switching element. This makes it possible to prevent hazardous tensions being transmitted from the switching element to the transmission means or the key, respectively. It is thus ensured that when the key switch is installed, a housing with protective insulation is not negligently bypassed.

The key monitoring can be advantageously divided into two phases. The first phase of the key switch corresponds to a key position which is detected by the transmission device (s) and can be translated for actuation. The second phase corresponds to a key position in which the device for key monitoring is capable of bringing about a key ejection. In this connection, it is appropriate if, in the first phase, the key cannot be held in the key channel without assistance by the operator.

The key switch is then in the first phase if the key is located between the initial key position outside the key channel and a first key position partially inside the key channel. The key is here subjected to a restoring force effect which is essentially attributable to the second elastic element. Blocking an axial movement of the telescopic sleeve defines the first key position. The blocking defines the transition from the first to the second phase.

In the second phase, the telescopic sleeve is fixed but the telescopic rod remains moveable in the telescopic sleeve by loading the first elastic element. If the key is inserted further into the key channel, it is also subjected to a restoring force effect essentially by the first elastic element. The second phase ends with the maximum insertion of the telescopic rod in the telescopic sleeve.

BRIEF DESCRIPTION OF THE DRAWINGS

The invention will be described below in greater detail and explained with reference to the example embodiment shown in the figures, in which.

DETAILED DESCRIPTION OF THE EXAMPLE EMBODIMENTS

Figure 1:
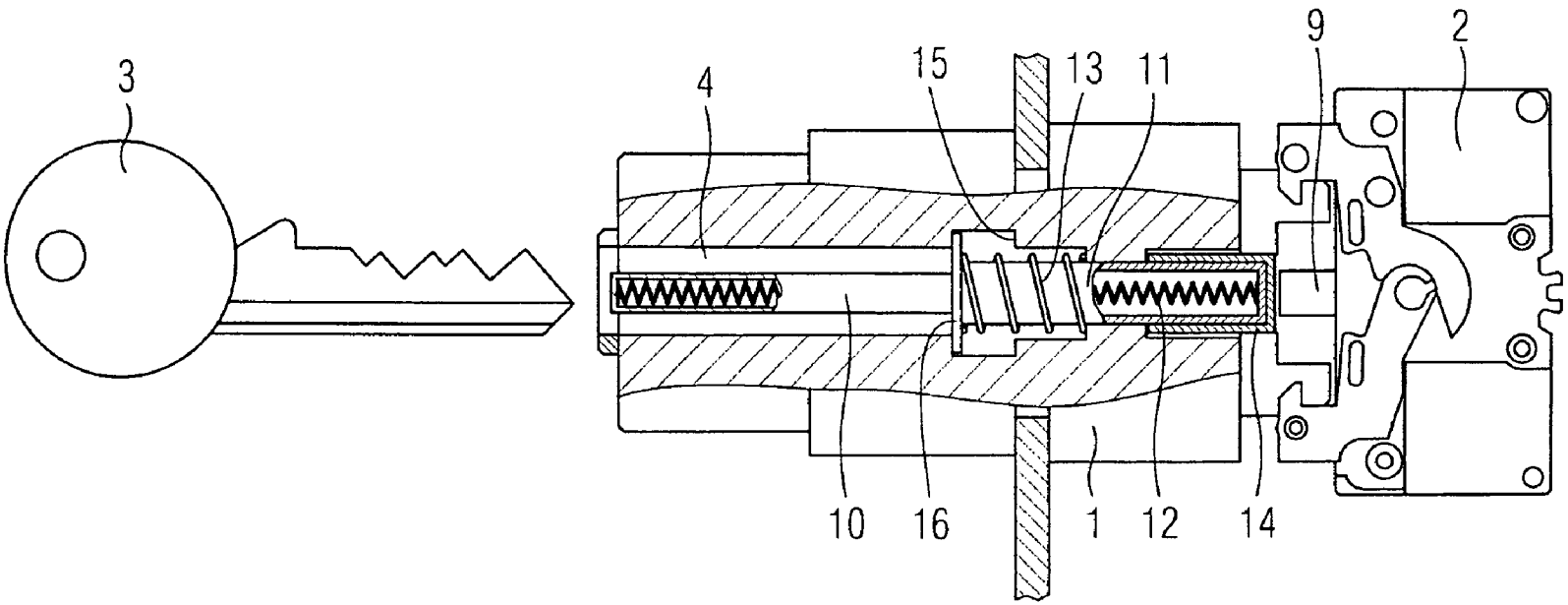
FIG. 1 shows a partially sectioned view of a key switch with the key pulled out.

FIG. 1 shows a partially sectioned view of a key switch with the key 3 pulled out. The key switch 1 has a key channel 4 for receiving the key 3, an axially arranged quasi-rigid system which is formed from the transmission device(s) 10, 11, 12, i.e. telescopic rod 10, telescopic sleeve 11, first elastic element 12, being located inside the key channel 4. A second elastic element 13 is provided for an axial restoring force effect on the quasi-rigid system which opposes the movement of insertion of the key 3.

In this arrangement, the first elastic element 12 is constructed as telescopic spring and the second elastic element 13 is constructed as return spring. To implement a quasi-rigid system which operates optimally, the first elastic element 12 is installed already pretensioned in the un-operated installation position. Due to the pretensioning, it is possible to ensure an almost direct transmission of force via the first elastic element 12 to the telescopic sleeve 11.

In this arrangement, the pretensioning force of the first elastic element 12 is equal to or greater than the sum of the forces of the second elastic element 13 and of the actuating force of the switching element 2. The second elastic element 13 thus has the function of restoring the quasi-rigid system, that is to say, in particular, restoring the telescopic sleeve 11 into the initial position (key 3 pulled out). In this arrangement, a relatively weak restoring force can be provided ergonomically advantageously for the actuator 9 of the switching element 2. The joint effect of the elastic elements 12, 13 mentioned prevents the key 3 from remaining in the lock which, in most cases, is undesirable in its removed position. However, the first elastic element 12 provides the major proportion of the force effect in this arrangement.

The first elastic element 12 is advantageously guided both by the telescopic sleeve 11 and by the telescopic rod 10. In addition, the first elastic element 12 is contained at least partially in the telescopic rod 10. As a result, a first elastic element 12, which is very long in relation to its diameter, is provided with good guidance and the length of the quasi-rigid system or of its transmission devices 10, 11, 12, respectively including the constructional height/installation depth of the key switch, can be optimized. In addition a long spring provides for a flat characteristic which is advantageous for the operation. In consequence, a very slight increase in force can be achieved in the first phase with respect to the required pretension when inserting the key into the key channel. This contributes to the ease of operation of the key switch.

The telescopic rod 10 and the telescopic sleeve 11 can be manufactured of metal and, for safety reasons, require an insulating sleeve 14 which prevents the transmission devices 10, 11, 12 being electrically contacted by the actuator 9 or by the switching element 2. This prevents any hazardous voltage from being transferred to the lock body.

Figure 2:
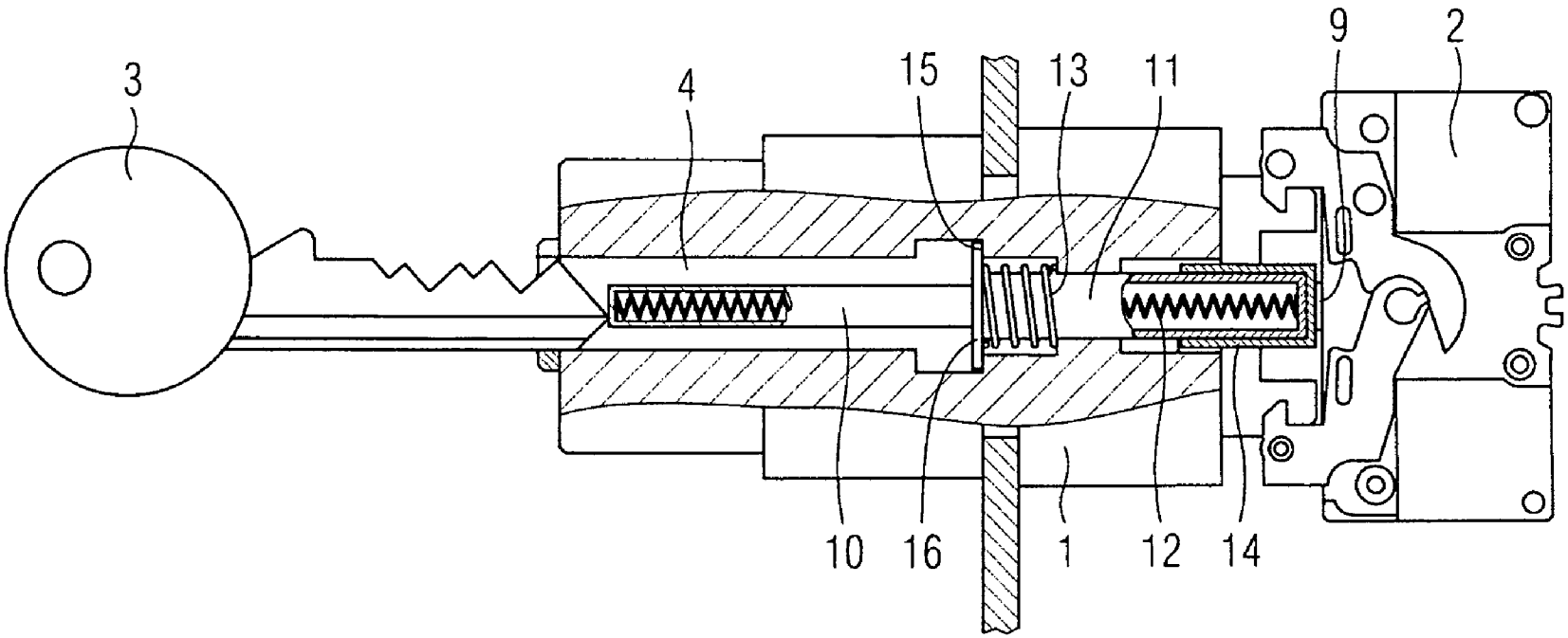
FIG. 2 shows a partially sectioned view of the key switch in the first phase.

FIG. 2 shows a partially sectioned view of the key switch in the first phase. The key 3 is at a first key position. The quasi-rigid system, consisting of the telescopic rod 10, the telescopic sleeve 11, the first elastic element 12 and the insulation sleeve 14 in its totality has moved unchanged along the key channel 4 in comparison with FIG. 1.

At the same time, the transmission devices 10, 11, 12 have not moved with respect to one another. It is only the second elastic element 13, which does not belong to the quasi-rigid system, which has hitherto been deformed elastically. In comparison, the first elastic element 12 is pretensioned in such a manner that it essentially has not been elastically deformed in comparison with the initial position (without force effect of the key 3). Furthermore, the operation of the actuator 9 of the switching element 2 took place during the first phase, that is to say between the initial key position and the first key position.

The first key position is defined by a stop 15 and by an annular molded extension 16 of the telescopic sleeve 11 stopping against it. As a result, it is possible to allow the force acting on the switching element 2 or its mounting to become no greater than the actuating force of the springs for contact pressure and/or returning the actuator 9.

At the first key position, the process of inserting the key is not yet concluded since the insertion length of conventional keys is approx. 20 to 30 mm and switching elements such as they are typically used in control devices are designed, for example, for a shorter actuating path of 3 to 6 mm which is physically also due to the number of closing pins required for security reasons. For this reason, the telescopic rod 10 is pushed into the blocked telescopic sleeve 11 in opposition to the increasing spring force of the first elastic element 12 during the further insertion of the key 3 into the key channel 4 beyond the first key position.

The quasi-rigid system is now in the second phase, the relative position of at least one transmission devices 11 (the telescopic sleeve 11 in the present exemplary embodiment) being changed in comparison with the other transmission devices 10, 12. The actuator 9 is no longer loaded during this process but, the further the key 3 is inserted, the higher the effect of the force on the key 3 due to the elastic deformation of the first elastic element 12.

Figure 3:
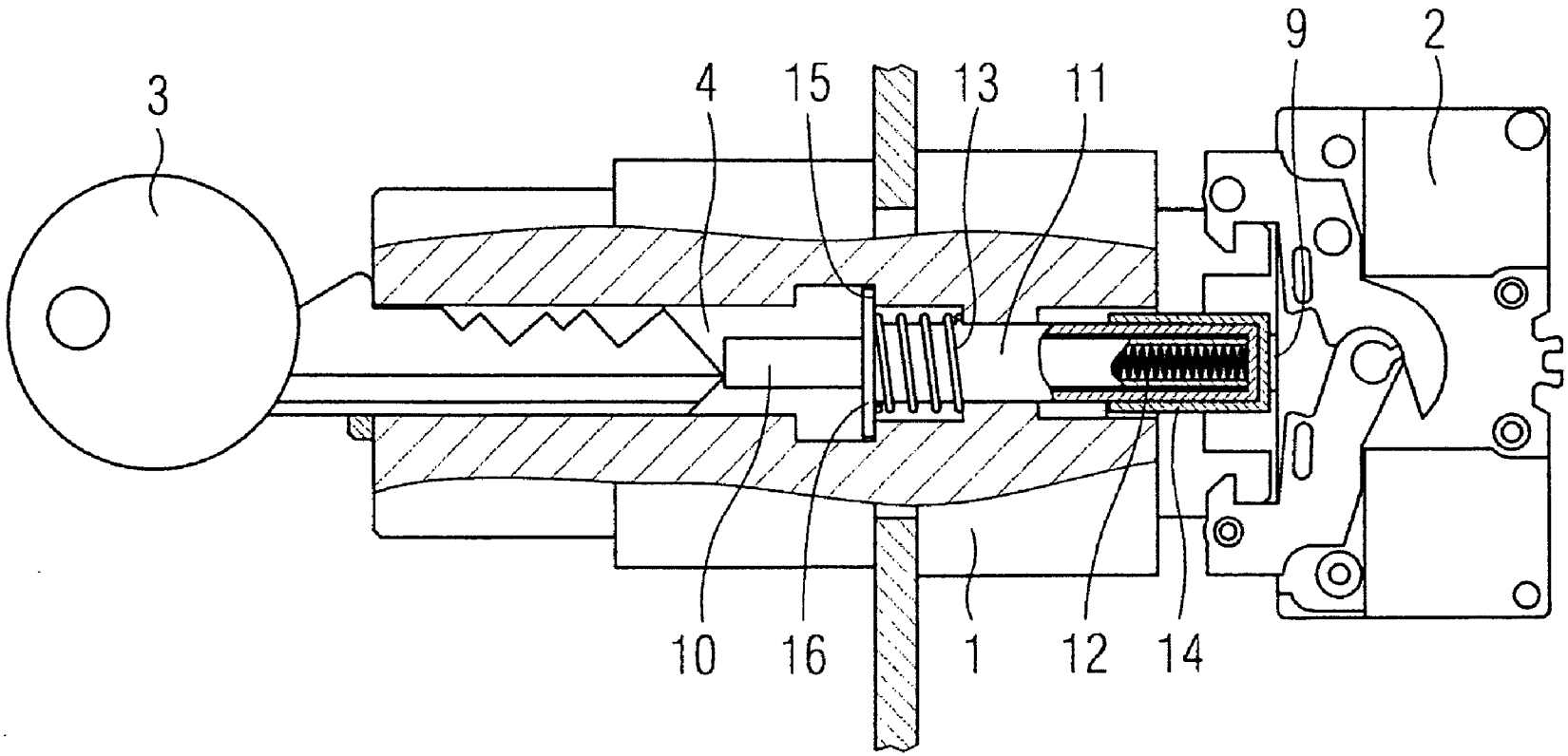
FIG. 3 shows a partially sectioned view of the key switch in the second phase.

FIG. 3 shows a partially sectional view of a key switch with the key 3 in the final key position. The telescopic rod 10 has reached the maximum possible depth of insertion of the telescopic sleeve 11. At the same time, the key 3 is inserted in the key channel 4 up to the stop. In this state, the effect of force of the first elastic element 12 is the greatest.

In this exemplary embodiment, the transmission devices 10, 11, 12 are dimensioned in such a manner that when the telescopic rod 10 is completely pushed in and the key is inserted up to the stop, the end of the telescopic sleeve 11 has traveled the distance necessary for operating the switching element 2 and a mandatory opening of the normally-closed contacts is ensured. The transmission of force from the key 3 to the telescopic rod 10, to the telescopic sleeve 11 and to the insulating sleeve 14, respectively, is positive and, in consequence, also ensured in the case of faulty elastic elements 12, 13.

In summary, at least one embodiment of the invention relates to a key switch with a key channel for receiving a key and a key-insertion-dependent switching mechanism, the switching mechanism exhibiting a device for key monitoring. As a solution, a key switch is specified which can be manufactured inexpensively and has additional security-related options. For this purpose, the key switch exhibits a device for key monitoring which exhibits transmission means, axially arranged in the key channel, which form a quasi-rigid system and are provided for key ejection and for operating a switching element.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A key switch comprising:

a key channel for receiving a key; and a key-insertion-dependent switching mechanism, the switching mechanism exhibiting a device for key monitoring in the key channel, the device exhibiting at least one axially moveable quasi-rigid system including transmission means for operating at least one actuator of the key switch, wherein in a first state of the quasi-rigid system, a relative position of the transmission means with respect to one another cannot be changed, and in a second state of the quasi-rigid system, the relative position of at least one transmission means with respect to another transmission means is changeable, the quasi-rigid system being in the first state or second state depending on the key position in the key channel, wherein the quasi-rigid system, in the first state, is provided for operating the actuator of the key switch.

2. The key switch as claimed in claim 1, wherein effects of restoring force on the key are different in the first state and in the second state.

3. The key switch as claimed in claim 1, wherein the quasi-rigid system is provided for key ejection in the second state.

4. The key switch as claimed in claim 1, wherein the device for key monitoring exhibits at least one first elastic element and one second elastic element, the first elastic element being a transmission means.

5. The key switch as claimed in claim 4, wherein the second elastic element is operateable by way of a force transmission via the first elastic element.

6. The key switch as claimed in claim 4, wherein at least the first elastic element is pretensionable in such a manner that, during reception of the key, the second elastic element and then the first elastic element are deformable.

7. The key switch as claimed in claim 4, wherein the quasi-rigid system includes, as at least a portion of the transmission means, a telescopic rod for the axial transmission of force from the key to the first elastic element.

8. The key switch as claimed in claim 7, wherein the telescopic rod at least one of contains the first elastic element and is provided for guiding it.

9. The key switch as claimed in claim 7, wherein the quasi-rigid system exhibits a telescopic sleeve which at least partially at least one of contains the telescopic rod and is provided for guiding it.

10. The key switch as claimed in claim 9, wherein the telescopic sleeve is provided for transmitting force from the first elastic element to the second elastic element.

11. The key switch as claimed in claim 9, wherein at least one of the telescopic sleeve and the key channel limits the effect of the key force on the second elastic element depending on the position of the key.

12. The key switch as claimed in claim 9, wherein the telescopic sleeve is provided for operating the actuator of at least one switching element.

13. The key switch as claimed in claim 9, wherein an insulating sleeve is provided between the telescopic sleeve and the actuator.

14. The key switch as claimed in claim 1, wherein at least a first key position is provided between an initial key position and a final key position, the first key position indicating a change in the effect of a restoring force on the key.

15. The key switch as claimed in claim 14, wherein the effect of restoring force between the initial key position and the first key position is essentially predetermined by the second elastic element and the effect of restoring force between the first key position and the final key position is essentially predetermined by the first elastic element.

16. The key switch as claimed in claim 14, wherein the first key position is fixed by the blocking of an axial movement of a telescopic sleeve.

17. The key switch as claimed in claim 16, wherein the telescopic rod is movable relative to the telescopic sleeve between the first key position and the final key position.

18. The key switch as claimed in claim 1, wherein the restoring force of the first elastic element provides a key ejection feature.

* * * * *